US009874099B2

(12) United States Patent
Rexavier et al.

(10) Patent No.: US 9,874,099 B2
(45) Date of Patent: Jan. 23, 2018

(54) TURBOCHARGER HAVING IMPROVED RUPTURE CONTAINMENT

(71) Applicant: Electro-Motive Diesel, Inc., LaGrange, IL (US)

(72) Inventors: Raji Rexavier, Plainfield, IL (US); Gary Svihla, Burr Ridge (IL)

(73) Assignee: Electro-Motive Diesel, Inc., LaGrange, IL (US)

( * ) Notice: Subject to any disclaimer, the term of this patent is extended or adjusted under 35 U.S.C. 154(b) by 392 days.

(21) Appl. No.: 14/789,605

(22) Filed: Jul. 1, 2015

(65) Prior Publication Data

US 2017/0002828 A1 Jan. 5, 2017

(51) Int. Cl.
*F01D 5/02* (2006.01)

(52) U.S. Cl.
CPC ..... *F01D 5/021* (2013.01); *F05D 2220/40* (2013.01)

(58) Field of Classification Search
CPC . F01D 5/025; F01D 5/06; F01D 5/021; F01D 21/045; B22F 5/04; F05D 2220/40
See application file for complete search history.

(56) References Cited

U.S. PATENT DOCUMENTS 2,922,619 A * 1/1960 Slemmons ..... B23P 15/006 416/213 R
3,928,963 A 12/1975 Devers et al.
3,973,875 A * 8/1976 Bird ..... C04B 35/591 416/241 B
4,970,125 A * 11/1990 Janney ..... B22C 9/04 428/579
5,154,581 A 10/1992 Borufka et al.
5,527,020 A 6/1996 Ganesh et al.
6,250,883 B1 6/2001 Robinson et al.
6,287,091 B1 9/2001 Svihla et al.
8,858,874 B2 10/2014 Tin et al.
8,918,996 B2 12/2014 Wessman et al.
2011/0280735 A1 11/2011 Dakowski et al.
2013/0266428 A1 10/2013 Panambur et al.
2014/0174098 A1 6/2014 Duong et al.
2014/0255198 A1 9/2014 El-Wardany et al.

FOREIGN PATENT DOCUMENTS

CN 204041121 U 12/2014

* cited by examiner

*Primary Examiner* — Gregory Anderson
*Assistant Examiner* — Eldon Brockman
(74) *Attorney, Agent, or Firm* — Miller, Matthias & Hull

(57) ABSTRACT

A turbocharger for a powered machine including a turbine is disclosed. The turbocharger may include a turbine wheel including a disk section, the disk section including a disk body, the disk body including a length extending between a longitudinal axis and a blade platform. The disk section may further include a shoulder section positioned radially outward the longitudinal axis, a neck section positioned radially outward the shoulder section and a throat section positioned radially outward the neck section, an upstream axial plane coextensive with an upstream side of the blade platform, a downstream axial plane coextensive with a downstream side of the blade platform. Further, the turbine burst shield section may have a geometry that peaks in depth in the burst plane which prevents ejection of secondary mass in the event of a turbine burst.

19 Claims, 5 Drawing Sheets

TURBOCHARGER HAVING IMPROVED RUPTURE CONTAINMENT

TECHNICAL FIELD

This disclosure generally relates to turbochargers and, more specifically, relates to turbochargers having improved rupture containment.

BACKGROUND

Powered machines often include one or more turbochargers for compressing a fluid such as air, which is then supplied to combustion cylinders of a power source. Exhaust gases are directed to and drive a turbine wheel of the turbocharger. The turbine wheel may be connected to a shaft that drives a compressor wheel. Ambient air is compressed by the compressor wheel and fed into the intake manifold of the power source, thereby increasing power output.

As the turbine wheel rotates, centrifugal force created may exceed a material rupture threshold and the turbine wheel may rupture, thereby releasing kinetic energy from the rotating wheel into the turbocharger and surrounding components. Ordinarily, this kinetic energy is contained by adding material to the casing surrounding the turbine wheel in its rupture plane. However, the addition of this material can add significant weight or cost to the powered machine to which such turbocharger is attached. Further, the addition of material to the rupture plane may cause undesirable fatigue related to thermomechanical phenomena in such turbocharger. Accordingly, turbocharger designers are continually seeking ways to absorb kinetic energy of turbine wheel ruptures without significantly increasing the amount of the surrounding casing material.

One attempt to minimize the amount of material released from a device, and thereby decrease the amount of kinetic energy that needs to be contained, is disclosed in Chinese Patent Application having publication number CN204041121 (the '121 patent application). The '121 patent application is directed to a bladed disk (a.k.a., a blisk) for an aircraft engine. Material fatigue may cause the blisk to fracture, and the fractured portion may impinge upon other portions of the aircraft engine or aircraft. In order to increase passenger safety, the '121 patent application describes a ceramic blisk with a concave portion positioned radially outward a root portion and a blade. Consequently, in the event of a failure, the section radially outward the root portion may fracture, and therefore less material is likely to impinge upon other portions of the aircraft engine and aircraft.

While arguably effective for its specific purpose, the '121 patent application is related to aircraft engines, and in no way related to turbochargers. Accordingly, the '121 patent in no way describes, or alludes to, a turbine for a turbocharger. Moreover, the '121 patent in no way describes or alludes to any additional modifications of its blisk, or other features of a system that may be used in conjunction with its modified blisk, to contain the kinetic energy released in the event of a rupture.

The present disclosure is directed to overcoming one or more problems set forth above and/or other problems associated with the prior art.

SUMMARY

In accordance with one embodiment of the present disclosure, a turbocharger turbine wheel disk section is disclosed. The disk section may include a disk body including a center plane, an upstream axial plane and a downstream axial plane. The upstream axial plane may be coextensive with an upstream side of the blade platform and parallel to the center plane, and the downstream axial plane may be coextensive with a downstream side of the blade platform. The disk body may further include a length extending between a longitudinal axis and a blade platform, a shoulder section positioned radially outward the longitudinal axis, a neck section positioned radially outward the shoulder section and a throat section positioned radially outward the neck section. The shoulder section may extend between about 20% and about 55% of the length and include a convex contour relative to the upstream axial plane or the downstream axial plane.

In accordance with another embodiment of the present disclosure, a turbine section for a turbocharger is disclosed. The turbine section may include a turbine wheel including a disk section and the disk section may include a disk body. The disk body may include a length extending between a longitudinal axis and a blade platform, and further include a shoulder section positioned radially outward the longitudinal axis, a neck section positioned radially outward the shoulder section and a throat section positioned radially outward the neck section. The disk body may further include an upstream axial plane that is coextensive with an upstream side of the blade platform and a downstream axial plane that is coextensive with a downstream side of the blade platform. The turbine section may further include an inlet duct including a first end and a second end, the first end may be positioned radially inward the second end. The first end may be located longitudinally upstream of the upstream side and the second end may located longitudinally downstream of the downstream side. The inlet duct may further include a burst shield section longitudinally positioned between the first end and the second end and radially outward of the turbine wheel. The turbine section may further include an outlet duct including a first side and a second side, the first side positioned radially inward the second side and longitudinally downstream of the downstream side, the second side positioned longitudinally upstream of the upstream side. The outlet duct may further include a turbine shroud section positioned radially outward of the turbine wheel and radially inward of the burst shield section and longitudinally between the upstream side and the downstream side.

These and other aspects and features of the present disclosure will be more readily understood when read in conjunction with the accompanying drawings.

BRIEF DESCRIPTION

DETAILED DESCRIPTION OF THE DISCLOSURE

Figure 1:
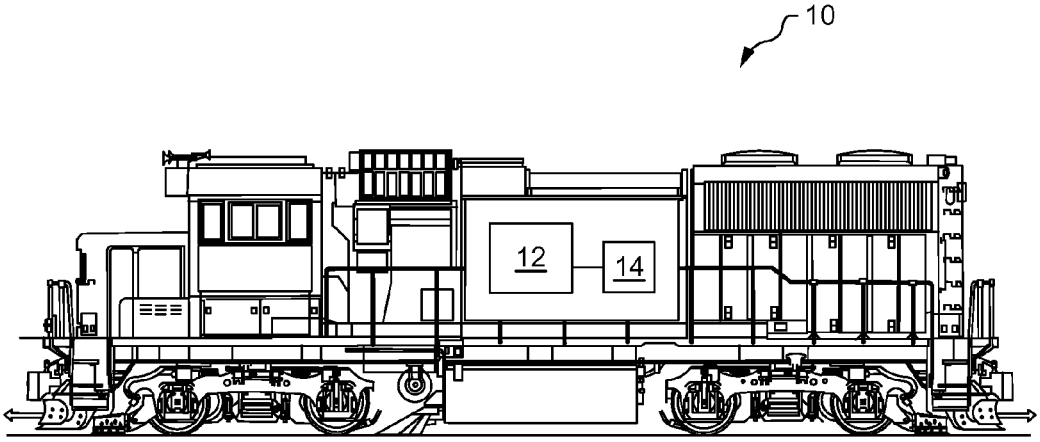
FIG. 1 is a side, plan view of a powered machine that may utilize a turbocharger having improved rupture containment disclosed herein.

Referring now to the drawings and with specific reference to FIG. 1, a powered machine 10 is shown. While the powered machine 10 depicted is locomotive, this is only exemplary, as the teaching of the present disclosure may be employed elsewhere too. For example, the present disclosure may be used with another powered machine 10, such as, automobiles, pickup trucks, on highway trucks, off highway trucks, articulated trucks, asphalt pavers, cold-planers, excavators, track-type tractors, tractors, motor graders, forest skidders, backhoe loaders, stationary power generators, marine applications, such as ships or boats, etc. Powered machine 10 may further include a power source 12 and a turbocharger 14 operatively engaged with power source 12. The power source 12 may be provided in any number of different forms including, but not limited to, Otto and Diesel cycle internal combustion engines, hybrid engines and the like.

Figure 2:
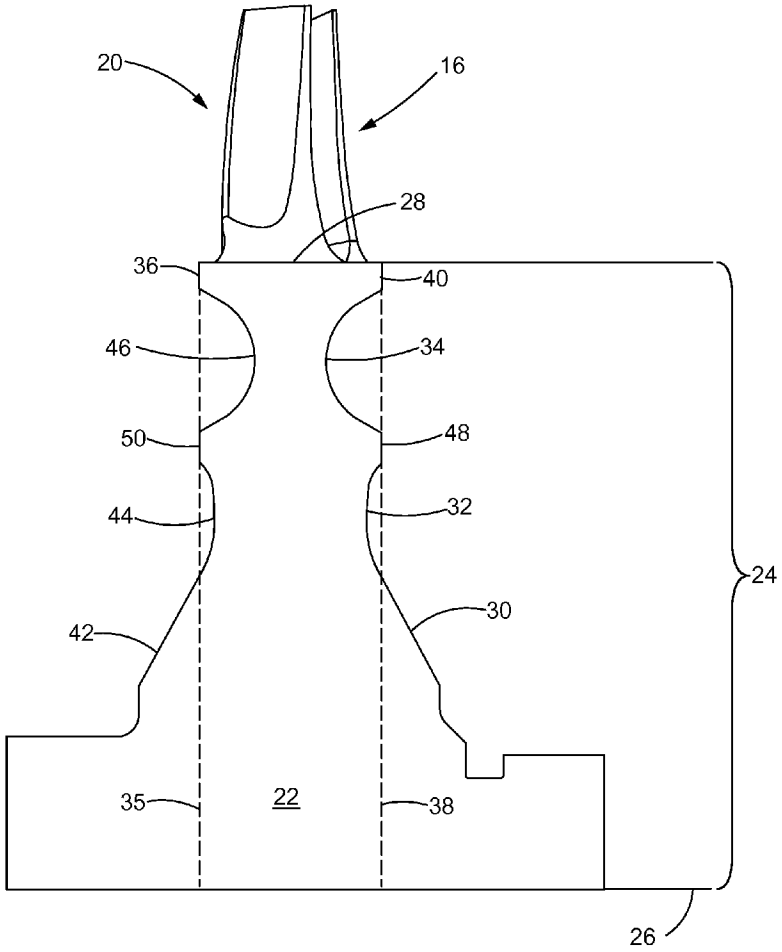
FIG. 2 is a side, profile view of a turbine wheel that may be used in the conjunction with the turbocharger having improved rupture containment disclosed herein.

Turning now to FIG. 2, a side, profile view of a turbocharger 14 turbine wheel 16 that may be used in the conjunction with the turbocharger 14 for a powered machine 10 having improved rupture containment disclosed herein, is generally depicted as reference numeral 16. As shown there, the turbine wheel 16 may include a disk section 18 and blade section 20. The disk section 18 may include a disk body 22 that includes a length 24 extending between a longitudinal axis 26 and a blade platform 28. The disk body 22 may further include a shoulder section 30 that may be positioned radially outward the longitudinal axis 26, a neck section 32 positioned radially outward the shoulder section 30 and a throat section 34 positioned radially outward the neck section 32 along the length 24. Further, disk body 22 may include an upstream axial plane 35 that is coextensive with an upstream side 36 of the blade platform 28 and a downstream axial plane 38 that is coextensive with a downstream side 40 of the blade platform 28. In addition, the shoulder section 30 may extend between about 20% and about 55% of the length 24 and include a convex contour 42 relative to the upstream axial plane 35 or the downstream axial plane 38.

Still referring to FIG. 2, the neck section 32 may extend between about 45% and about 70% of the length 24 and may include a first concave contour 44 relative to the upstream axial plane 35 or the downstream axial plane 38. Moreover, the throat section 34 may extend between about 75% and about 95% of the length 24 and may include a second concave contour 46 relative to the upstream axial plane 35 or the downstream axial plane 38. Finally, disk body 22 may further include a balancing ring section 48 positioned radially outward the neck section 32 and radially inward the throat section 34. Balancing ring section 48 may extend between about 60% and about 80% of length 24 and have a flat contour 50 relative to the upstream axial plane 35 or the downstream axial plane 38. Without intending to be limiting, turbine wheel 16 may be made of metal alloys, such as castable nickel-based alloys.

Figure 3:
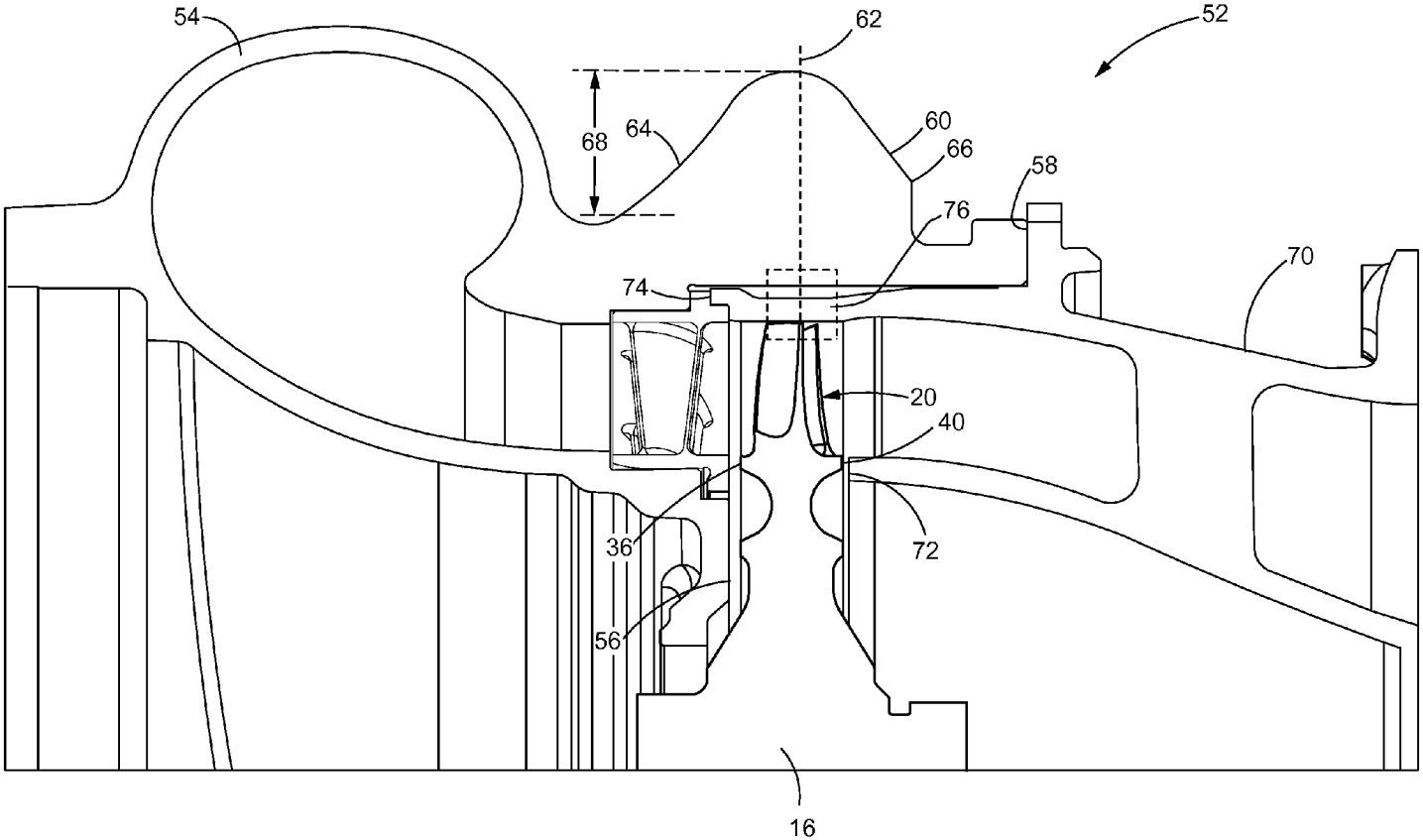
FIG. 3 is a side, profile view of a turbine section that may be used in conjunction with turbocharger having improved rupture containment disclosed herein.

Referring now to FIG. 3, a side, profile view of a turbocharger 14 turbine section 52 that may be used with the turbocharger 14 having improved rupture containment disclosed herein is generally referred to by reference numeral 52. As seen there, the turbine wheel 16 according to FIG. 2 may be used in conjunction with turbine section 52 having improved rupture containment. Further, turbine section 52 may include an inlet duct 54, and the inlet duct 54 may include a first end 56 and a second end 58. First end 56 may be positioned radially inward the second end 58 and longitudinally upstream of upstream side 36 of the turbine wheel 16. Conversely, second end 58 may be located radially outward the first end 56 and longitudinally downstream of downstream side 40 of turbine wheel 16.

Inlet duct 54 may further include a burst shield section 60 positioned between first end 56 and second end 58. Further, burst shield section 60 of inlet duct 54 may be positioned radially outward the turbine wheel 16 and in a rupture plane 62 of expected travel of turbine wheel 16 fragments in the event the turbine wheel 16 ruptures. The rupture plane 62 may be orthogonal to the longitudinal axis 26. Moreover, burst shield section 60 may include an upstream end 64 positioned longitudinally forward of upstream side 36 of the turbine wheel 16 and a downstream end 66 positioned longitudinally downstream of downstream side 40 of turbine wheel 16. Further, burst shield section 60 may further include a thickness 68 that increases when moving from either the upstream end 64 or the downstream end 66 towards the rupture plane 62. Accordingly, the thickness 68 or burst shield section 60 peaking at the rupture plane 62.

Still referring to FIG. 3, turbine section 52 may further include an outlet duct 70. The outlet duct 70 may include a first side 72 and a second side 74. First side 72 may be positioned radially inward second side 74 and longitudinally downstream of downstream side 40 of the turbine wheel 16. Conversely, second side 74 may be positioned radially outward of first side 74, and may further be positioned longitudinally upstream of upstream side 26 of the turbine wheel 16.

Outlet duct 70 may further include a turbine shroud section 76 which is positioned radially outward of turbine wheel 16 and radially inward the burst shield section 60 of the inlet duct 54. Turbine shroud section 76 may generally longitudinally extend between upstream side 36 and downstream side 40 of turbine wheel 16.

Figure 4:
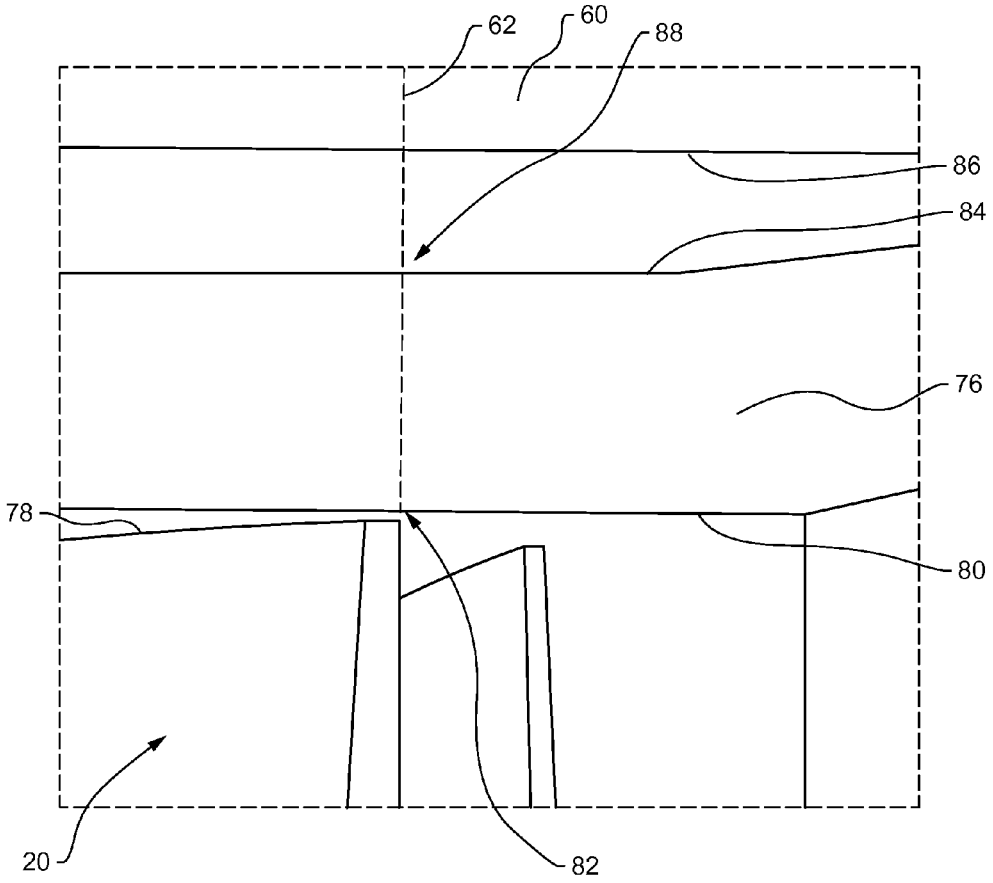
FIG. 4 is a portion view of FIG. 3, enlarged for magnification purposes.

Turning now to FIG. 4, additional features of the turbine section 52 are depicted in the portion view of FIG. 3, enlarged for magnification purposes. As seen in FIG. 4, blade section 20 of turbine wheel 16 may include a blade tip 78, while turbine shroud section 76 may include a radially inward wall 80. Further, as seen there, the blade tip 78 and the radially inward wall 80 do not touch, therefore including a first gap 82 therebetween these two features. Additionally, turbine shroud section 76 may further include a radially outward wall 84 and the burst shield section 60 may also include a radially inward leg 86. As seen in FIG. 4, the radially outward wall 84 may not touch the radially inward leg 86, therefore including an expansion space 88 therebetween these two features. As further seen in these figures, first gap 82 is radially inward of expansion space 88 and both are located in the rupture plane 62. Without meaning to be limiting, inlet duct 54 and outlet duct 70 may be made from a castable metal, such as castable ductile iron. In some instances the castable ductile iron may be further alloyed with other elements to impart improved characteristics at elevated temperatures.

INDUSTRIAL APPLICABILITY

In operation, turbocharger 14 may include a turbine wheel 16 including a disk section 18 that rotates about longitudinal axis 26. As the turbine wheel 16 rotates, centrifugal force created may exceed a material rupture threshold and the turbine wheel 16 may rupture, thereby releasing kinetic energy from a rotating turbine wheel 16 into the turbocharger 14 and surrounding components. Ordinarily, this kinetic energy is contained by adding material to the casing surrounding the turbine wheel 16 in its rupture plane 62. However, the addition of this material can add significant weight or cost to the powered machine 10 to which such turbocharger 14 is attached. Further, the addition of material to the rupture plane 62 may cause undesirable fatigue related to thermomechanical phenomena in such turbocharger 14. Accordingly, the designers of a turbocharger 14 are continually seeking ways to absorb kinetic energy of turbine wheel 16 ruptures without significantly increasing the amount of the surrounding casing material.

One such improved system is described herein. As a first point, the turbocharger 14 may utilize a turbine wheel 16 having a disk section 18 with a profile according to FIG. 2. Conventionally a turbine wheel 16 disk section 18 generally only has a concave shape between its longitudinal axis 26 and its blade platform 28 relative to an upstream axial plane 35 or a downstream axial plane 38. Thus, in the case of rupture, any amount of length 24 of the disk section 18 between the longitudinal axis 26 and the blade platform 28 may be expelled. Accordingly, due to the varying amounts kinetic energy that may be expelled during rupture of such a conventional design, turbocharger 14 designers typically utilize enough casing material to absorb the kinetic energy of the largest portion of the disk section 18. Accordingly, such a turbocharger 14 has significant weight and cost added to their designs. Further, such designs experience undesirable fatigue related to thermomechanical phenomena in such turbocharger 14.

Alternatively, turbocharger 14 designers may utilize a turbine wheel 16 having a disk section 18 profile according to the '121 patent application. The disk section 18 profile of the '121 patent application may include a shoulder section 30 positioned radially outward the longitudinal axis 26 and throat section 34 located radially outward the shoulder section 30. The throat section 34 is to serve as a natural rupture point for a disk section 18 including such a profile. However, like the conventional profile described above, the '121 patent application generally only has a concave shape between its longitudinal axis 26 and its blade platform 28 relative to an upstream axial plane 35 or a downstream axial plane 38. Thus, in the case of rupture, any amount of length 24 of the disk section 18 between the longitudinal axis 26 and the blade platform 28 may be expelled, even though the throat section 34 is to serve as natural fracture point. Accordingly, due to the varying amounts kinetic energy that may be expelled during rupture of the '121 patent application design, turbocharger 14 designers would have to utilize enough casing material to absorb the kinetic energy of the largest portion of the disk section 18. Accordingly, such turbocharger 14 would have significant weight and cost added to their designs. Further, such designs experience undesirable fatigue related to thermomechanical phenomena in such turbocharger 14.

In comparison to the foregoing, the disk section 18 profile according to the current invention ensures that minimum amount of the length 24 between the longitudinal axis 26 and the blade platform 28 is expelled in the event of a rupture by including a shoulder section 30 located radially outwards of the longitudinal axis 26, extending between about 20% and about 55% of the length 24 and having a convex contour 42 relative to either the upstream axial plane 35 or the downstream axial plane 38. Further, the disk section 18 profile according to the current invention ensures the minimal amount of length 24 being expelled during a rupture by having a neck section 32 positioned radially outward the shoulder section 30, extending between about 45% and about 70% of the length 24 and having a first concave contour 44. Moreover, this invention ensures the minimal amount of length 24 being expelled during a rupture by further including throat section 34 positioned radially outward the neck section 32, extending between about 70% and about 95% of the length 24. These features create a distinct strain separation between the shoulder section 30 and the throat section 34, thereby ensuring that rupture occurs at the throat section 34. As a consequence, turbocharger 14 designers utilizing disk section 18 profiles according to FIG. 2 may contain turbine wheel 16 ruptures without significantly increasing the amount of surrounding casing material.

As a corollary of the foregoing disk section 18 design, less material may be used to contain a turbocharger 14 turbine wheel 16 rupture since less kinetic energy is released. Accordingly, the turbine section 52 according to FIGS. 3-4 may be used in conjunction with a turbine wheel 16 having a profile according to FIG. 2 to readily contain a turbine wheel 16 rupture. As a first mechanism to contain the reduced kinetic energy of such a turbine wheel 16 rupture, first gap 82 serves as a void across which the expelled portion moves. The expelling portion of the turbine wheel 16 may impinge upon the radially inward wall 80 which serves to absorb some of the kinetic energy. The turbine shroud section 76 may then be forced radially outward towards the burst shield section 60 further absorbing the kinetic energy of the expelling portion of the turbine wheel 16. As the turbine shroud section 76 absorbs the kinetic energy, the surface area of the turbine shroud section 76 may increase until the radially outward wall 84 meets the radially inward leg 86 across the expansion space 88. Then, the expelling portion of the turbine wheel 16 may pierce the turbine shroud section 76 and impinge the burst shield section 60. Since the burst shield section 60 has a wider width near the radially inward leg 86 than radially further away from the longitudinal axis 26, a large elastic energy absorption band is created that further absorbs the kinetic energy of the expelling portion of the turbine wheel 16, and prevents secondary ejection of the expelling portion through it. Lastly, this prevents the secondary ejection of the expelling portion either longitudinally upstream or downstream of the rupture plane 62.

Figure 5:
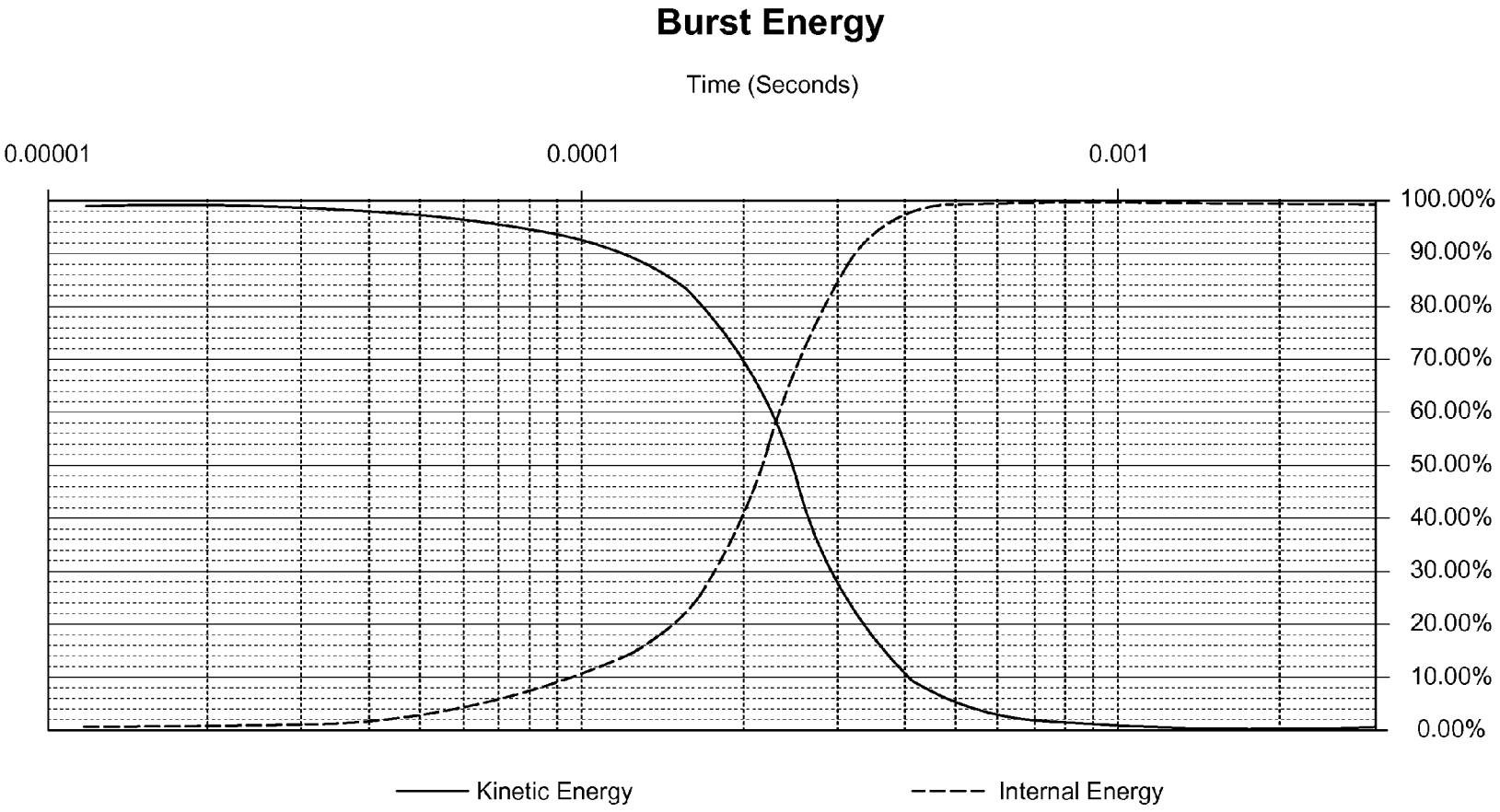
FIG. 5 is a graph illustrating kinetic energy of a fragment released from a turbine wheel having a profile according to FIG. 2, and the absorption of the kinetic energy with the turbine section according to FIGS. 3-4 with respect to time.

Evidence of the kinetic energy containment may be seen in FIG. 5. As shown there, the kinetic energy of piece of the of the expelling portion of the turbine wheel 16, including the throat section 34, and anything else radially outward of the throat section 34, as represented by the solid line, may decrease to zero percent within about three milliseconds, while this same amount of energy may be transferred to the surrounding turbine shroud section 76 and burst shield section 60 as internal energy and sound energy. Therefore, a disk section 18 having the profile according to FIG. 2 may be used in conjunction with a turbine section 52 having the features according to FIGS. 3-4 to absorb a turbine wheel 16 rupture without utilizing additional material, or unique shields, that increase turbocharger 14 cost or create undesirable fatigue related to thermomechanical phenomena in the turbocharger 14.

The above description is meant to be representative only, and thus modifications may be made to the embodiments described herein without departing from the scope of the disclosure. Thus, these modifications fall within the scope of present disclosure and are intended to fall within the appended claims.

What is claimed is:

1. A turbocharger for a powered machine, comprising:

a turbine wheel including a disk section, the disk section including a disk body, the disk body including a length extending between a longitudinal axis and a blade platform, a shoulder section positioned radially outward the longitudinal axis, a neck section positioned radially outward the shoulder section and a throat section positioned radially outward the neck section, the disk body including an upstream axial plane that is coextensive with an upstream side of the blade platform, the disk body including a downstream axial plane that is coextensive with a downstream side of the blade platform and, the shoulder section extending between about 20% and about 55% of the length and including a convex contour relative to the upstream axial plane or the downstream axial plane.

2. The turbocharger according to claim 1, the neck section extending between about 45% and about 70% of the length.

3. The turbocharger according to claim 2, the neck section including a first concave contour relative to the upstream axial plane or the downstream axial plane.

4. The turbocharger according to claim 1, the throat section extending between about 70% and 95% of the length.

5. The turbocharger according to claim 4, the neck section including a second concave contour relative to the upstream axial plane or the downstream axial plane.

6. The turbocharger according to claim 1, the disk body further including a balancing ring section, the balancing ring section radially outward the neck section and radially inward the throat section, the balancing ring section extending between about 60% and about 80% of the length and having a flat contour relative to the upstream axial plane or the downstream axial plane.

7. A turbine section for a turbocharger, comprising:

a turbine wheel including a disk section, the disk section including a disk body, the disk body including a length extending between a longitudinal axis and a blade platform, a shoulder section positioned radially outward the longitudinal axis, a neck section positioned radially outward the shoulder section and a throat section positioned radially outward the neck section, the disk body including an upstream axial plane that is coextensive with an upstream side of the blade platform, the disk body including a downstream axial plane that is coextensive with a downstream side of the blade platform;

an inlet duct, the inlet duct including a first end and a second end, the first end positioned radially inward the second end, the first end located longitudinally upstream of the upstream side, the second end located longitudinally downstream of the downstream side, the inlet duct further including a burst shield section longitudinally positioned between the first end and the second end and radially outward of the turbine wheel; and an outlet duct, the outlet duct including a first side and a second side, the first side positioned radially inward the second side and longitudinally downstream of the downstream side, the second side positioned longitudinally upstream of the upstream side, the outlet duct further including a turbine shroud section, the turbine shroud section positioned radially outward of the turbine wheel and radially inward of the burst shield section and longitudinally between the upstream side and the downstream side.

8. The turbine section according to claim 7, the turbine wheel further including a blade tip, the turbine shroud section further including a radially inward wall, the blade tip and the radially inward wall including a first gap therebetween.

9. The turbine section according to claim 8, the turbine shroud section further including a radially outward wall, the burst shield section may include a radially inward leg, the radially outward wall the and the radially inward leg including an expansion space therebetween.

10. The turbine section according to claim 9, the burst shield section further including an upstream end and a downstream end, the upstream end longitudinally upstream of the upstream side and the downstream end longitudinally downstream of the downstream side.

11. The turbine section according to claim 10, further including a rupture plane, the rupture plane positioned between upstream side and downstream side, the burst shield section further including a thickness, the thickness increasing between the upstream end and towards the rupture plane.

12. The turbine section according to claim 11, the thickness increasing between the downstream end and towards the rupture plane.

13. The turbine section according to claim 12, the thickness of the burst shield section peaking at the rupture plane.

14. The turbine section according to claim 13, the shoulder section extending between about 20% and about 55% of the length and including a convex contour relative to the upstream axial plane or the downstream axial plane.

15. The turbine section according to claim 14, the neck section extending between about 45% and about 70% of the length.

16. The turbine section according to claim 15, the neck section including a first concave contour relative to the upstream axial plane or the downstream axial plane.

17. The turbine section according to claim 16, the throat section extending between about 70% and 95% of the length.

18. The turbine section according to claim 17, the neck section including a second concave contour relative to the upstream axial plane or the downstream axial plane.

19. The turbine section according to claim 18, the disk body further including a balancing ring section, the balancing ring section radially outward the neck section and radially inward the throat section, extending between about 60% and about 80% of the length and having a flat contour relative to the upstream axial plane or the downstream axial plane.

* * * * *